United States Patent [19]

Crumpton

[11] 4,071,049

[45] Jan. 31, 1978

[54] LOOM PICKER

[76] Inventor: Charles H. Crumpton, P.O. Box 386, Lancaster, S.C. 29720

[21] Appl. No.: 758,672

[22] Filed: Jan. 12, 1977

[51] Int. Cl.[2] ..... D03D 49/36
[52] U.S. Cl. ..... 139/159
[58] Field of Search ..... 139/159, 160

[56] References Cited

U.S. PATENT DOCUMENTS

| | | | |
|---|---|---|---|
| 1,852,812 | 4/1932 | Leiby | 139/160 R |
| 1,989,910 | 2/1935 | Brahs | 139/160 R |
| 2,585,435 | 2/1952 | Chadbourne | 139/160 R |
| 2,707,004 | 4/1955 | Holt | 139/160 R |
| 3,000,076 | 9/1961 | Runton et al. | 139/160 R |
| 3,415,290 | 12/1968 | Lacey et al. | 139/159 |
| 3,738,397 | 6/1973 | Budzyna | 139/159 |

FOREIGN PATENT DOCUMENTS

| | | | |
|---|---|---|---|
| 426,521 | 4/1935 | United Kingdom | 139/160 R |
| 320,616 | 10/1929 | United Kingdom | 139/160 R |
| 774,011 | 5/1957 | United Kingdom | 139/160 R |
| 708,122 | 4/1954 | United Kingdom | 139/159 |
| 352,522 | 7/1931 | United Kingdom | 139/159 |
| 866,796 | 5/1961 | United Kingdom | 139/160 R |

*Primary Examiner*—James Kee Chi
*Attorney, Agent, or Firm*—B. P. Fishburne, Jr.

[57] ABSTRACT

A molded loom picker has greatly increased resistance to heat and abrasion caused by impact of the shuttle on the picker nose. The picker embodies asbestos fabric and/or asbestos fibers combined with heat curable resin, elastomers and materials which exhibit a low coefficient of friction, such as Teflon. The product is extremely tough and durable and its useful life can by up to fifty per cent longer than prior art loom pickers.

5 Claims, 1 Drawing Figure

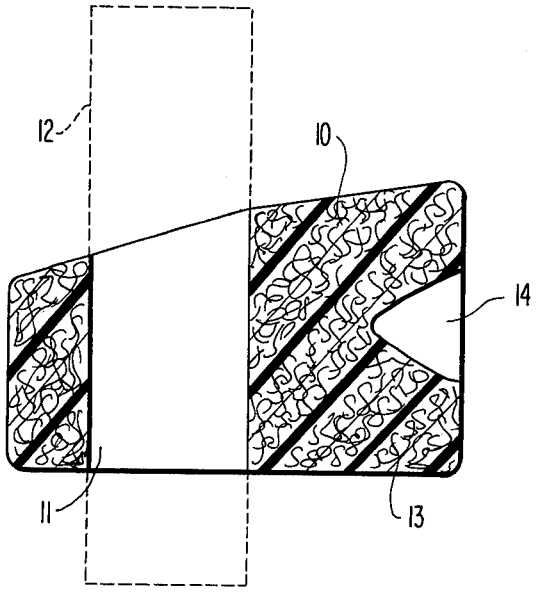
12
10
14
11
13

LOOM PICKER

BACKGROUND OF THE INVENTION

The prior art contains numerous teachings relating to the manufacturing of a loom pickers to render them longer-lasting and more able to withstand the pounding of the shuttle against the picker nose in loom operation. Many present-day loom pickers comprise layers of woven synthetic fabric, such as polyester fabric, calendered with rubber or rubber-like compounds. The calendered fabric is then wrapped on a rigid form, layer by layer, and each layer is brushed with a suitable resin or otherwise saturated with resin. The green picker is then placed in a mold and baked under an elevated temperature and pressure for a sufficient time to cure the picker to a hard and very tough state. Following removal from the mold and minor trimming and finishing operations, the picker is ready for use. While the prior art contains some variance in the above procedure, the described construction is quite typical of the prior art.

Some examples of the patented prior art are U.S. Pat. Nos. 2,032,734; 2,341,904; 649,698; 2,161,662 and 2,219,380.

In spite of a rather sophisticated state of the art relating to the making of loom pickers evidenced by the above-referenced patents, this simple element which is so vital to the operation of a shuttle loom continues to represent a challenging problem and a need which is not yet satisfied in terms of durability and desirable life span of the picker on a modern-day shuttle loom. One main reason for the less than ideal performance of the picker on a high speed loom is its inability to withstand the heat and abrasion resulting from the repeated impact of the shuttle knurl on the picker nose. Even though present-day pickers are very tough and impact resistant, they are not constructed to reduce the friction at the instant of impact and thereby reducing the heat of friction as well as abrasion. Accordingly, it is the objective of this invention to advance the art relating to the manufacture of loom pickers by providing a picker which, in addition to being tough and impact resistant, also embodies elements or constituents which reduce friction and the heat of friction as well as abrasion, thereby increasing the life of the picker as much as fifty percent compared to the most efficient types currently used.

SUMMARY OF THE INVENTION

A loom picker is made from asbestos fabric and/or asbestos fibers compounded with an elastomer and a heat curable synthetic resin and a solid lubricant or lubricants, such as graphite and/or Teflon. The picker may be fabricated by injection molding or compression molding in a suitable molding press.

DESCRIPTION OF THE DRAWINGS

The drawing FIGURE is a central vertical cross section through a loom picker embodying the present invention.

DETAILED DESCRIPTION

A loom picker embodying the present invention comprises in one preferred form of the invention a unitary molded picker body 10 having a through opening 11 extending from top to bottom thereof to receive the picker stick 12 and a nose block 13 having a center recess 14 to receive the knurl or point of the shuttle, not shown.

The picker can be injection molded or compression molded in a suitable press at a sufficiently elevated temperature to cure the picker to a hard, tough and durable state. Essentially, the picker is formed from asbestos fibers mixed with an uncured elastomer, such as rubber or synthetic rubber-like material, a dry solid lubricant and a synthetic resin. These consituents are thoroughly mixed and can be placed in a conventional molding press at a curing temperature of roughly 300° F. Following compression at this approximate temperature for about 27 to 30 minutes will produce a picker which is hard, extremely tough and resistant to impact, and also possessing the additional important features of high resistance to abrasion and a significant reduction in heat during operation on a loom, as the result of reduced friction. Such heat as is generated due to friction is resisted in the picker by the asbestos fibers which are distributed thoughout the body of the picker in a homogeneous manner.

In lieu of free asbestos fibers, the picker can be fabricated from woven asbestos fabric. Such fabric when used is calendered with an uncured elastomer, such as rubber or synthetic rubber. The fabric is then wrapped, layer upon layer, on a rigid form and each layer is painted or otherwise saturated with a curable resin to which dry lubricating material such as teflon or graphite has been added. The product thus formed, while in the green stage, is placed in a mold and baked at the approximate temperature and for the time previously noted.

When the picker is formed from a homogenous mixture of asbestos fibers, resin, an elastomer and solid lubricant, it can be injection molded instead of compression molded, if desired.

A preferred embodiment of the invention can be specifically described in terms of the following example:

EXAMPLE I

A compression molded loom picker is produced from a homogeneous mixture of asbestos fibers, urethane elastomer, commercial synthetic resin and Teflon in the following proportions by weight:

Asbestos fibers - 95%
Urethane elastomer - 1%
Resin - 1%
Teflon - 3%

A loom picker according to the invention can be produced according to the following example:

EXAMPLE II

Woven asbestos fabric is calendered with uncured synthetic rubber and saturated layer-by-layer in a wrap-up with commercial synthetic resin containing Teflon fibers in the following proportions by weight:

Asbestos fabric - 90%
Synthetic rubber - 5%
Resin - 1%
Teflon fibers - 4%

In both of the above examples, the Teflon constituent can be replaced by an equivalent amount by weight of graphite particles. Various commercial resins may be used in both examples.

A picker embodying the invention can also be made according to the following example:

EXAMPLE III

In lieu of urethane or other natural or synthetic elastomer, a picker can be molded from a mixture of polyamide-B compounded with a natural or synthetic elastomer and dry solid lubricant (either graphite or Teflon) in the following proportions by weight:

Polyamide-B - 97%
Elastomer - 2%
Lubricant - 1%

In all cases, the appropriate molding techniques, whether compression molding or injection molding, are conventional.

The picker produced according to the invention, in addition to the qualities of toughness and impact resistance, has excellent resistance to abrasion and less frictional heat during loom operation as a result of reduced friction, the latter characteristic being provided by the addition of a solid dry lubricant. The frictional heat which is inherently developed during loom operation is greatly resisted in the picker by the asbestos, whether in the form of free fibers or fabric layers.

It is to be understood that the form of the invention herewith shown and described is to be taken as a preferred example of the same, and that various changes in the shape, size and arrangement of parts may be restored to, without departing from the spirit of the invention or scope of the subjoined claims.

I claim:

1. A loom picker comprising a substantially homogeneous molded body consisting of at least 90% asbestos, substantially 5% elastomer, and the balance by weight being a resin and a solid lubricant.

2. A loom picker as defined in claim 1, and said asbestos comprising woven asbestos fabric.

3. A loom picker as defined in claim 2, and said elastomer comprising a synthetic rubber and said solid lubricant comprising Teflon.

4. A loom picker as defined in claim 2, and said molded body formed of united layers of said asbestos fabric calendered with said elastomer and saturated with said resin containing said solid lubricant.

5. A loom picker as defined in claim 4, and said solid lubricant consisting of Teflon fibers.

* * * * *